US010035181B2

(12) United States Patent
Kato et al.

(10) Patent No.: US 10,035,181 B2
(45) Date of Patent: Jul. 31, 2018

(54) APPARATUS AND A METHOD FOR RECLAIMING FOUNDRY SAND

(71) Applicant: SINTOKOGIO, LTD., Nagoya-shi, Aichi (JP)

(72) Inventors: Yusuke Kato, Toyokawa (JP); Toshihiko Zenpo, Toyokawa (JP); Tomohiro Aoki, Toyokawa (JP); Takehiko Matsumoto, Toyokawa (JP); Takumi Maegawa, Toyota (JP); Hirotsune Watanabe, Toyota (JP); Tomokazu Suda, Toyota (JP); Masaomi Mitsutake, Toyota (JP); Hisao Nakane, Toyota (JP)

(73) Assignee: SINTOKOGIO, LTD., Aichi (JP)

( * ) Notice: Subject to any disclaimer, the term of this patent is extended or adjusted under 35 U.S.C. 154(b) by 641 days.

(21) Appl. No.: 14/384,312

(22) PCT Filed: Apr. 12, 2013

(86) PCT No.: PCT/JP2013/061036
§ 371 (c)(1),
(2) Date: Sep. 10, 2014

(87) PCT Pub. No.: WO2013/190888
PCT Pub. Date: Dec. 27, 2013

(65) Prior Publication Data

US 2015/0096594 A1 Apr. 9, 2015

(30) Foreign Application Priority Data

Jun. 20, 2012 (JP) ..... 2012-139205

(51) Int. Cl.
*B22C 5/02* (2006.01)
*B22C 5/18* (2006.01)
(Continued)

(52) U.S. Cl.
CPC ..... *B22C 5/185* (2013.01); *B08B 3/044* (2013.01); *B08B 3/045* (2013.01); *B08B 3/10* (2013.01);
(Continued)

(58) Field of Classification Search
CPC ..... B22C 5/02
See application file for complete search history.

(56) References Cited

U.S. PATENT DOCUMENTS 5,515,907 A * 5/1996 Boenisch ..... B22C 5/00 164/150.1

FOREIGN PATENT DOCUMENTS

JP 52-99924 8/1977
JP 56-30054 3/1981
(Continued)

OTHER PUBLICATIONS

English-language International Search Report from the Japanese Patent Office for International Application No. PCT/JP2013/061036, dated Jul. 16, 2013.

*Primary Examiner* — Jason Ko
(74) *Attorney, Agent, or Firm* — Finnegan, Henderson, Farabow, Garrett & Dunner, LLP

(57) ABSTRACT

To provide an apparatus for reclaiming foundry sand and a method for reclaiming foundry sand that can effectively remove binders and so on that attach to returned foundry sand that has been used. Foundry sand that has been used is supplied from a chute for feeding sand 14A to a rotor 16. The rotor 16 is rotated by a driver 20 so that frictional force is generated on the sand in the rotor 16. Then, the sand in the rotor 16 is dropped into the container for washing with water 30 that is located below the rotor 16. In the container for washing with water 30, an agitator 34 is rotated by the driver
(Continued)

20 so that the sand in the container for washing with water 30 is agitated and washed with water.

7 Claims, 9 Drawing Sheets

(51) Int. Cl.

| | |
|---|---|
| ***B22C 5/04*** | (2006.01) |
| ***B08B 3/04*** | (2006.01) |
| ***B08B 3/10*** | (2006.01) |
| ***B08B 7/02*** | (2006.01) |

(52) U.S. Cl.
CPC ..... *B08B 7/02* (2013.01); *B22C 5/02* (2013.01); *B22C 5/04* (2013.01); *B22C 5/0413* (2013.01); *B22C 5/0427* (2013.01); *B22C 5/0454* (2013.01)

(56) References Cited

FOREIGN PATENT DOCUMENTS

| | | | | |
|---|---|---|---|---|
| JP | 7-136735 | | | 5/1995 |
| JP | 7-314082 | | | 12/1995 |
| JP | 8-243682 | | | 9/1996 |
| JP | 08243682 | A | * | 9/1996 |
| JP | 2002-178100 | | | 6/2002 |
| JP | 2005-177759 | | | 7/2005 |
| JP | 2006-68815 | | | 3/2006 |
| JP | 2009-154207 | | | 7/2009 |

* cited by examiner

APPARATUS AND A METHOD FOR RECLAIMING FOUNDRY SAND

TECHNICAL FIELD

The present invention relates to an apparatus and a method for reclaiming foundry sand.

BACKGROUND ART

A method for washing returned foundry sand by water to reclaim returned foundry sand that has been used has been known (for example, see Japanese Patent Laid-open Publication Nos. S52-99924 and 2002-178100).

However, the method should be improved to effectively remove binders and so on that attach to the returned foundry sand.

In consideration of the above-mentioned facts, the object of the present invention is to provide an apparatus and a method for reclaiming foundry sand that can effectively remove binders and so on that attach to the returned foundry sand that has been used.

DISCLOSURE OF THE INVENTION

An apparatus for reclaiming foundry sand as the first aspect of the present invention comprises a container for treatment to which foundry sand that has been used is supplied. It also comprises a mechanism for generating frictional force that has a driver that rotates the container for treatment about a vertical axis. This mechanism generates frictional force on sand in the container for the treatment by rotating that container. It also comprises a container for washing with water that is located below the container for treatment and can have water supplied to and drained from it, which container for washing with water can receive sand that has been discharged from the container for treatment. It also comprises an agitator that has a shaft for agitation and blades for agitation. The shaft for agitation is connected to the driver to be rotated about a vertical axis. The blades for agitation are attached to the shaft for agitation and are located within the container for washing with water.

By the apparatus for reclaiming foundry sand as the first aspect of the present invention, the container for treatment to which foundry sand that has been used is supplied is rotated about a vertical axis by the driver of the mechanism for generating the frictional force. The mechanism for generating the frictional force rotates the container for treatment so that the frictional force is generated to the sand in the container for treatment. Thus incrustations on the surfaces of the particles of the sand are cracked so that some of the incrustations are removed from the surfaces of the particles of the sand. The container for washing with water that is located below the container for treatment can have water for washing supplied to and drained from it and receives the sand that has been discharged from the container for treatment. Inside the container for washing with water, the blades for agitation that are attached to the shaft for agitation are provided. The shaft for agitation is connected to the driver to be rotated about a vertical axis. Thus when water is supplied the agitator rotates so that incrustations, etc., that have been cracked are removed from the sand in the container for washing with water.

By the apparatus for reclaiming foundry sand as the second aspect of the present invention, in the apparatus of the first aspect the axis of rotation of the container for treatment is coaxial with the shaft for agitation.

By the apparatus for reclaiming foundry sand as the second aspect, wherein the axis of rotation of the container for treatment is coaxial with the shaft for agitation, while the space for the apparatus is reduced, a driving force is transmitted from the driver to the container for treatment and the agitator.

By the apparatus for reclaiming foundry sand as the third aspect of the present invention, in the apparatus of the first or second aspect the container for treatment is a cylindrical rotor with a horizontal bottom. Further, the mechanism for generating the frictional force has a ring that is adjacent to, and outside of, the upper end of the rotor. The ring has a plurality of blades that are circularly arranged and, in the planar view, incline opposite the direction of the rotation of the rotor in the inner radial direction.

By the apparatus for reclaiming foundry sand as the third aspect, wherein the container for treatment is a cylindrical rotor with a horizontal bottom, when the rotor rotates the particles of the sand that have been supplied to the rotor scrape each other and are deposited on the inner face of the side wall of the rotor by centrifugal force. The mechanism for generating the frictional force has a ring that is adjacent to, and outside of, the upper end of the rotor and has a plurality of blades that are circularly arranged and, in the planar view, incline opposite the direction of the rotation of the rotor in the inner radial direction. Thus the sand that is higher than the upper end of the rotor is hit by the blades, to thereby be returned inside the rotor and again the particles scrape each other. In this way, since the sand is hit by the blades and the particles scrape each other, incrustations on the surfaces of the particles of the sand are effectively cracked so that some of the incrustations are removed from the surfaces of the particles of the sand.

By the apparatus for reclaiming foundry sand as the fourth aspect of the present invention, in the apparatus of the first or second aspect the container for treatment is a drum that has a circular and horizontal bottom, an inclined side wall that inclines so as to have its diameter increase upwardly from the periphery of the bottom, and a weir that extends inwardly from the upper end of the inclined side wall. The mechanism for generating the frictional force has rollers that rotate in the drum. They are disposed to face each other such that gaps between parts of the outer faces of the rollers and the inclined side wall are formed. It also has a mechanism for pressing the rollers that is disposed at the bearings of the rollers to press the rollers toward the inclined side wall.

By the apparatus for reclaiming foundry sand as the fourth aspect, the container for treatment is a drum that has a circular and horizontal bottom, an inclined side wall that inclines to have its diameter increase upwardly from the periphery of the bottom, and a weir that extends inwardly from the upper end of the inclined side wall. Since in the mechanism for generating the frictional force the driver rotates the drum about a vertical axis, the particles of the sand that have been supplied to the drum scrape each other and are deposited on the inner face of the inclined side wall by centrifugal force.

The mechanism for generating the frictional force has rollers that rotate in the drum and are disposed to face each other such that gaps between parts of the outer faces of the rollers and the inclined side wall are formed. It also has a mechanism for pressing the rollers that is disposed at the bearings of the rollers to press the rollers toward the inclined side wall. Thus the sand that has been deposited on the inner face of the inclined side wall contacts the rollers to rotate them and to create the frictional force on the sand. Thus incrustations on the surfaces of the particles of the sand are cracked and some of the incrustations are removed from the particles of the sand. If the thickness of the sand that has been deposited on the inner face of the inclined side wall increases, the sand goes over the weir, to thereby be discharged.

The apparatus for reclaiming foundry sand as the fifth aspect of the present invention, in the apparatus of any of the first to fourth aspects, comprises an internally-located and horizontal board that is placed in the container for washing with water and connected to the lower end of the shaft for agitation via a bearing. It also comprises a section made of netting that connects the entire periphery of the internally-located board with the upper opening of the container for washing with water.

By the apparatus for reclaiming foundry sand as the fifth aspect, the periphery of the internally-located and horizontal board that is placed in the container for washing with water is connected to the upper opening of the container for washing with water by the section made of netting. Thus the sand that has been discharged from the container for treatment is received inside the section made of netting on the internally-located board that is placed in the container for washing with water. Thus by rotating the agitator while water is supplied to the container for washing with water, incrustations on the surfaces of the particles of the sand are scraped with the section made of netting. Thereafter, by rotating the agitator while water is drained from the container for washing with water, the scraped incrustations pass through the section made of netting with water to be discharged. Thus only the sand remains in the container for washing with water, and it is dried.

By the apparatus for reclaiming foundry sand as the sixth aspect of the present invention, in the apparatus of the fifth aspect, the container for washing with water is equipped with a vertically-moving machine that moves the container for washing with water up and down.

By the apparatus for reclaiming foundry sand as the sixth aspect, the container for washing with water is equipped with the vertically-moving machine that moves the container for washing with water up and down. Thus after being dried, the container for washing with water is moved down by the vertically-moving machine so that its top is opened. Then by rotating the agitator the sand that has been dried in the container for washing with water is discharged.

A method for reclaiming foundry sand as the seventh aspect of the present invention comprises a first step of feeding foundry sand that has been used to a section for treatment. It also comprises, after the first step, a second step of imparting frictional force or an impact to the sand in the section for treatment. It also comprises, after the second step, a third step of dropping the sand in the section for treatment into the container for washing with water that is located below the section for treatment. It also comprises, after the third step, a fourth step of washing the sand in the container for washing with water.

By the method for reclaiming foundry sand as the seventh aspect, in the first step foundry sand that has been used is supplied to the section for treatment. Next, in the second step frictional force or an impact is generated to the sand in the section for treatment. Next, in the third step, the sand in the section for treatment is dropped into the container for washing with water that is located below the section for treatment. In the fourth step the sand in the container for washing with water is washed. Thus in the second step incrustations on the surfaces of the particles of the sand are cracked and some of the incrustations are removed from the particles of the sand. In the fourth step, incrustations, etc., that are cracked are washed to then be removed from the sand.

By the method for reclaiming foundry sand as the eighth aspect of the present invention, in the fourth step in the method of the seventh aspect, water for washing in the container for washing with water is mixed with abrasives and the sand, water, and abrasives are agitated.

By the method for reclaiming foundry sand as the eighth aspect, in the fourth step water for washing in the container for washing with water is mixed with abrasives, and the sand, water, and abrasives are agitated. Thus incrustations on the surfaces of the particles of the sand are scraped by the abrasives.

By a method for reclaiming foundry sand as the ninth aspect of the present invention, in the third step in the method of the seventh or eighth aspect, the sand that is dropped from the section for treatment is subject to an airflow so that light materials that are removed from the sand to flow in the airflow are separated from heavy materials and so that the heavy materials are dropped into the container for washing with water.

By the method for reclaiming foundry sand of the ninth aspect, in the third step the sand that is dropped from the section for treatment is subject to an airflow so that light materials that are removed from the sand to flow in the airflow are separated from heavy materials and so that the heavy materials are dropped into the container for washing with water. Thus incrustations that have been separated from the particles of the sand are prevented or suppressed from dropping into the container for washing with water.

Advantageous Effects of the Invention

As discussed above, by the apparatus for reclaiming foundry sand or the method for reclaiming foundry sand of the present invention, binders and so on that have attached to returned foundry sand that has been used are effectively removed.

The basic Japanese patent application, No. 2012-139205, filed Jun. 20, 2012, is hereby incorporated by reference in its entirety in the present application.

The present invention will become more fully understood from the detailed description given below. However, the detailed description and the specific embodiment are illustrations of desired embodiments of the present invention, and are described only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein, is intended merely to better illuminate the invention, and so does not limit the scope of the invention, unless otherwise claimed.

BRIEF DESCRIPTION OF THE DRAWINGS

FIG. 2(A) shows the first step, FIG. 2(B) the second step, and FIG. 2(C) the third step.

FIG. 3(A) shows the status where the water for washing is supplied, FIG. 3(B) the fourth step, and FIG. 3(C) the status where the water for washing is drained.

FIG. 4(A) shows the status when centrifugal drying is carried out and FIG. 4(B) shows the status when the sand is being discharged.

BEST MODE FOR CARRYING OUT THE INVENTION

First Embodiment

Figure 1:
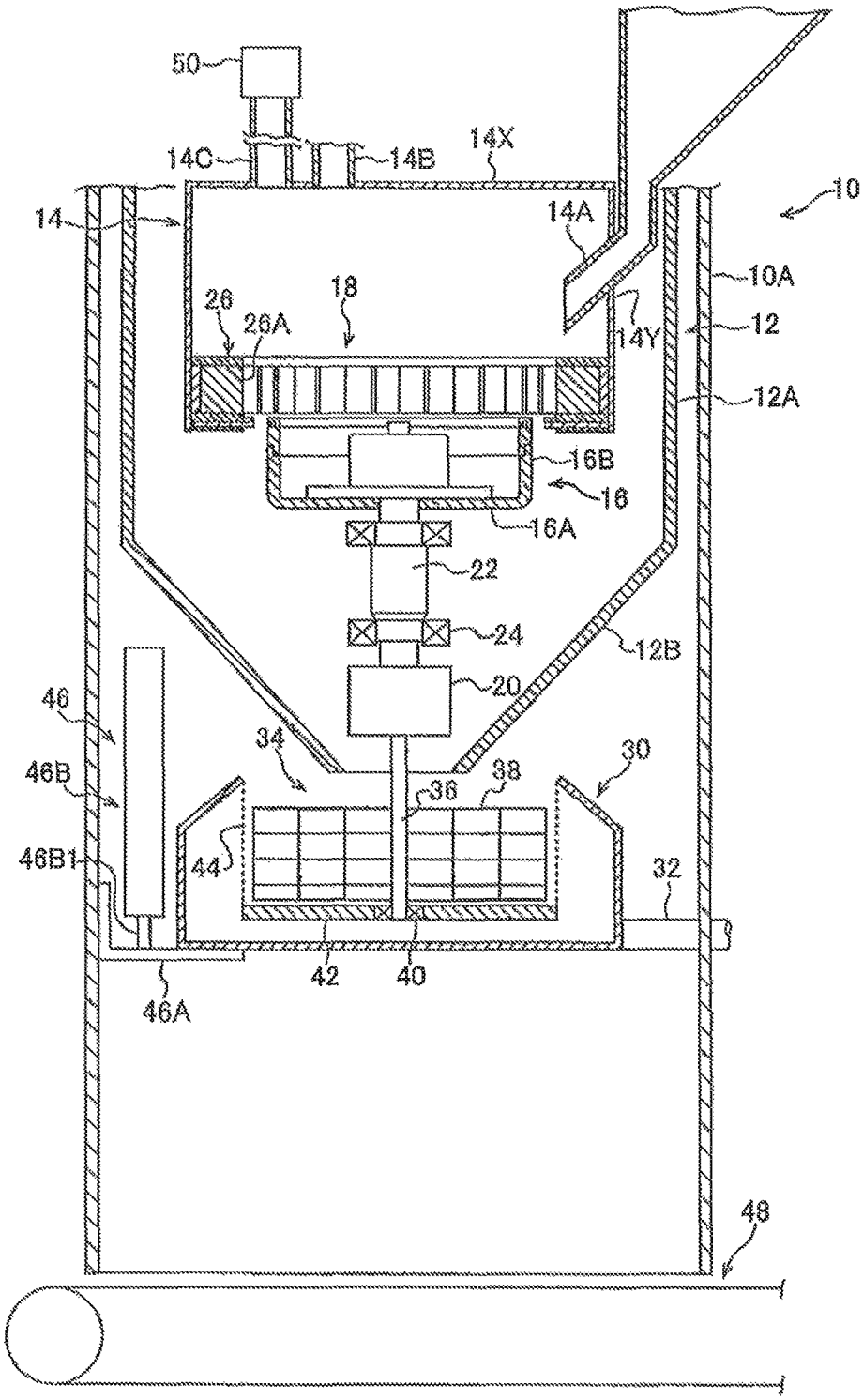
FIG. 1 is a vertical and sectional view of the entire structure of the apparatus for reclaiming foundry sand as the first embodiment of the present invention.

With reference to FIGS. 1-5, below the apparatus and method for reclaiming the foundry sand of the embodiments of the present invention are described. FIG. 1 illustrates a vertical and sectional view of the entire structure of the apparatus for reclaiming the foundry sand 10 of the first embodiment. The up and down directions in the figure correspond to the vertical direction of the apparatus for reclaiming the foundry sand 10.

As shown in FIG. 1, the apparatus for reclaiming the foundry sand 10 has a box-like main body 10A. In the upper portion of the main body 10A an upper container 12 is provided. The upper container 12 has a tubular section 12A. A hopper 12B is formed to be connected to the bottom of the tubular section 12A.

In the upper portion of the upper container 12 a container for treatment 14 is provided. A pipe for suctioning 14B and a pipe for discharging 14C are connected to the ceiling 14X of the container for treatment 14. The pipe for discharging 14C is connected to a dust collector 50 (shown as a block in the figure). The dust collector 50 has a section for suctioning air (a blower, which is not shown). Valves for adjusting the flow (not shown) are provided to the pipe for suctioning 14B and the pipe for discharging 14C. By this structure air can be suctioned and discharged to and from the container for treatment 14, and the pressure there is controlled.

A chute for feeding sand 14A is inserted from the outside of the side wall 14Y of the container for treatment 14. The chute for feeding sand 14A is used for feeding foundry sand that has been used (core sand may be contained). On the chute for feeding sand 14A a valve for adjusting the flow (not shown) is provided.

A rotor 16, which is a container for treatment to which foundry sand that has been used is supplied (the section for treatment), is provided below the chute for feeding sand 14A. The rotor 16 is formed as a cylinder with a horizontal bottom 16A. It has a side wall 16B that is upwardly formed from the periphery of the bottom 16A. The inner space of the rotor 16 is a part of a space of the container for treatment 14.

The rotor 16 is equipped with a mechanism for generating frictional force 18. Below, the structure of the mechanism for generating the frictional force 18 is discussed. A rotating shaft 22 is fixed to the bottom 16A of the rotor 16, and extends downwardly. The rotating shaft 22 is pivotably supported by a bearing 24 that is fixed to the upper container 12. At the lower end of the rotating shaft 22 a driver 20 (shown as a block in the figure) is provided. The driver 20 rotates the rotor 16 about a vertical axis by rotating the rotating shaft 22. Though the detailed description of the structure of the driver 20 is omitted, it has a first pulley that is attached to the bottom of the rotating shaft 22, a second pulley that is rotatably attached to the upper container 12, a belt that is wound between the first pulley and the second pulley, and a motor for rotating the second pulley. Further, a clutch is provided between the bottom of the rotating shaft 22 and the driver 20, though it is not illustrated. The clutch is used for changing the transmission of the power of the driver 20.

The mechanism for generating the frictional force 18 has a ring 26 that is adjacent to, and outside of, the upper end of the rotor 16, and that is fixed to the upper container 12. The ring 26 is positioned so that it is a little loose vertically in the space between it and the side wall 16B of the rotor. It has a diameter that is slightly larger than that of the rotor 16. Inside the ring 26 a plurality of blades 26A (mechanical targets for reclaiming sand) that are circularly arranged are provided. The blades 26A incline, in the planar view, opposite the direction of the rotation of the rotor 16 and in the radial direction. Thus the particles of the sand that are hit by the rotating blades 26A are pushed toward the center of the rotation.

As discussed above, the mechanism for generating the frictional force 18 generates it on the sand in the rotor 16 by rotating the rotor 16.

A container for washing with water 30 is provided just below the lower portion of the upper container 12 (below the rotor 16). That is, the container for washing with water 30 is located to receive the sand that is discharged from the rotor 16. The container for washing with water 30 functions as a container for reclaiming the sand in a wet condition and as a rotating container for drying the sand. A tube for supplying and draining water 32 is connected to the container for washing with water 30. Water for washing can be supplied to, and drained from, the container for washing with water 30 through the tube for supplying and draining the water 32. The tube for supplying and draining water 32 passes through an ellipsoidal hole (not shown) that extends vertically in the side wall of the main body 10A.

Inside the container for washing with water 30 an agitator 34 (a unit having the blades for agitation for reclaiming wet sand) is provided. The agitator 34 has a shaft for agitation 36 that is connected to the driver 20 to thereby rotate about a vertical axis and has blades for agitation 38 that are provided on the outer circumference of the shaft for agitation 36 and inside the container for washing with water 30. The shaft for agitation 36 is coaxially positioned with the rotating shaft 22

(the axis of rotation of the rotor 16). A clutch is provided between the top of the shaft for agitation 36 and the driver 20, though it is not illustrated. The clutch is used for changing the transmission of the power of the driver 20. In this embodiment the blades for agitation 38 are made of coarse mesh. Incidentally, the blades for agitation 38 may be made of plates without mesh.

An internally-located board 42 is connected to the bottom of the shaft for agitation 36 via a bearing 40. The internally-located board 42 is horizontally placed inside the container for washing with water 30. The periphery of the internally-located board 42 and the upper opening of the container for washing with water 30 are completely connected by a mesh made of stainless steel 44, which is a cylindrical section made of netting. In the figures the mesh made of stainless steel 44 is illustrated by dotted lines. The size of the netting of the mesh made of stainless steel 44 is determined so as to avoid the particles of the sand from passing through it.

A vertically-moving machine 46 that vertically moves the container for washing with water 30 up and down is provided to the container for washing with water 30. The vertically-moving machine 46 may be any known machine for vertically-moving an object. In this embodiment, as an example, the vertically-moving machine 46 has a sliding part 46A that is fixed to the container for washing with water 30 and vertically moves along the side wall of the main body 10A. It also has an air cylinder 46B that vertically moves the sliding part 46A by attaching the tip of the rod 46B1 to the sliding part 46A and extending and contracting the rod 46B1.

Below the main body 10A a conveyor belt 48 is provided. The conveyor belt 48 transports the sand that has been reclaimed in the main body 10A in a predetermined direction.

A Method for Reclaiming the Foundry Sand and its Functions and Effects

Next, a method for reclaiming the foundry sand that uses the apparatus for reclaiming the foundry sand 10 is discussed with reference to FIGS. 2 to 5. The functions and advantageous effects of the embodiment are also discussed.

Figure 5:
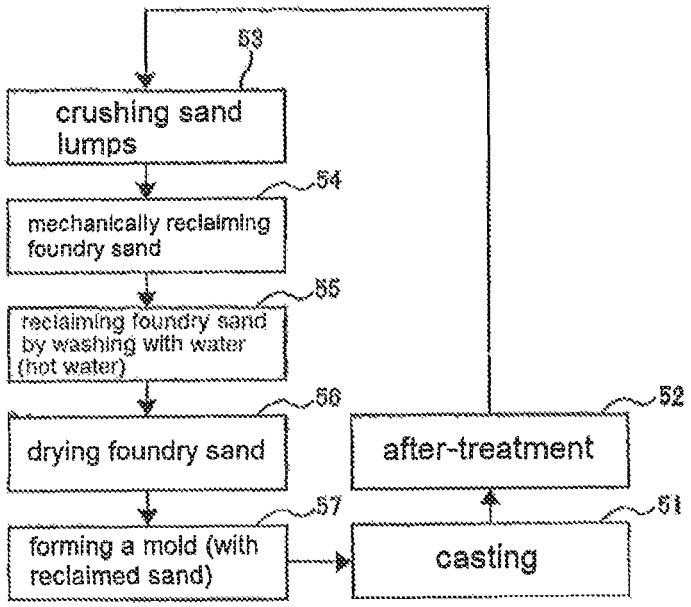
FIG. 5 is a flowchart that shows the cycle for reclaiming foundry sand.

A flowchart that illustrates steps for reclaiming the foundry sand is shown in FIG. 5. In the step of crushing sand lumps 53 in FIG. 5, sand lumps are crushed after the step of casting 51 and after the step of after-treatment 52, by a vibrating sieve or the like. After this step of crushing, magnetic separation may be carried out before the step of mechanically reclaiming the foundry sand 54. By the magnetic separation, unwanted metallic fragments are removed by means of a device using a magnet or a device using eddy currents.

After that above step, the step of mechanically reclaiming the foundry sand 54 and the step of reclaiming the foundry sand by washing with water (hot water) 55 are carried out by using the apparatus for reclaiming the foundry sand 10 (see FIG. 1). The details of these steps are discussed below. The step of mechanically reclaiming the foundry sand 54 and the step of reclaiming the foundry sand by washing with water (hot water) 55 are carried out to remove binders (for example, inorganic liquid-crystal binders) that adhere to a mold or foundry sand (aggregates) that has been used for casting.

In the step of drying foundry sand 56, to some extent the foundry sand that has been processed is dewatered or dried. Then the moisture in the sand is measured. For this measurement a device for measuring moisture, such as an electric resistance-type, a microwave-type, a near-infrared ray-type, a far-infrared ray-type, or a heating and drying-type device, is used. This measurement is necessary to determine the input of water that can produce mulled sand that has a constant moisture.

In the following step of casting 57, the sand that is necessary for casting is metered by a device for weighing sand or a device for measuring the volume of sand. Next, water is added to the sand to control the moisture so that the value that is required for the mulled sand can be achieved. Also, liquid-crystal is added to make the mulled sand have a strength that has a value that is required for a mold. Further, a surface-activating agent is added to the sand to improve its ability to form a mold and to produce a foamed mixture. A metering pump is used to add the water, the liquid-crystal, and the surface-activating agent. Next, the sand, the water, the liquid-crystal, and the surface-activating agent are uniformly mixed and agitated by a sand muller. The mixture is heated and hardened by means of forming by blowing compressed air (in the case of a foamed mixture, by means of forming a mold by injecting, or forming by blowing compressed air) to form a mold.

In the step of casting 51, molten metal is poured into a mold to produce a cast by gravity die casting, low pressure die casting, or die casting. In the step of an after-treatment 52, a cast is separated from the core sand by a vibrating sand-stripper, an impact-type sand-stripper, or the like, i.e., so called sand stripping is carried out.

Next, the step of mechanically reclaiming the foundry sand 54 and the step of reclaiming the foundry sand by washing with water (hot water) 55 are discussed with reference to FIGS. 2 and 3, respectively.

Figure 2:
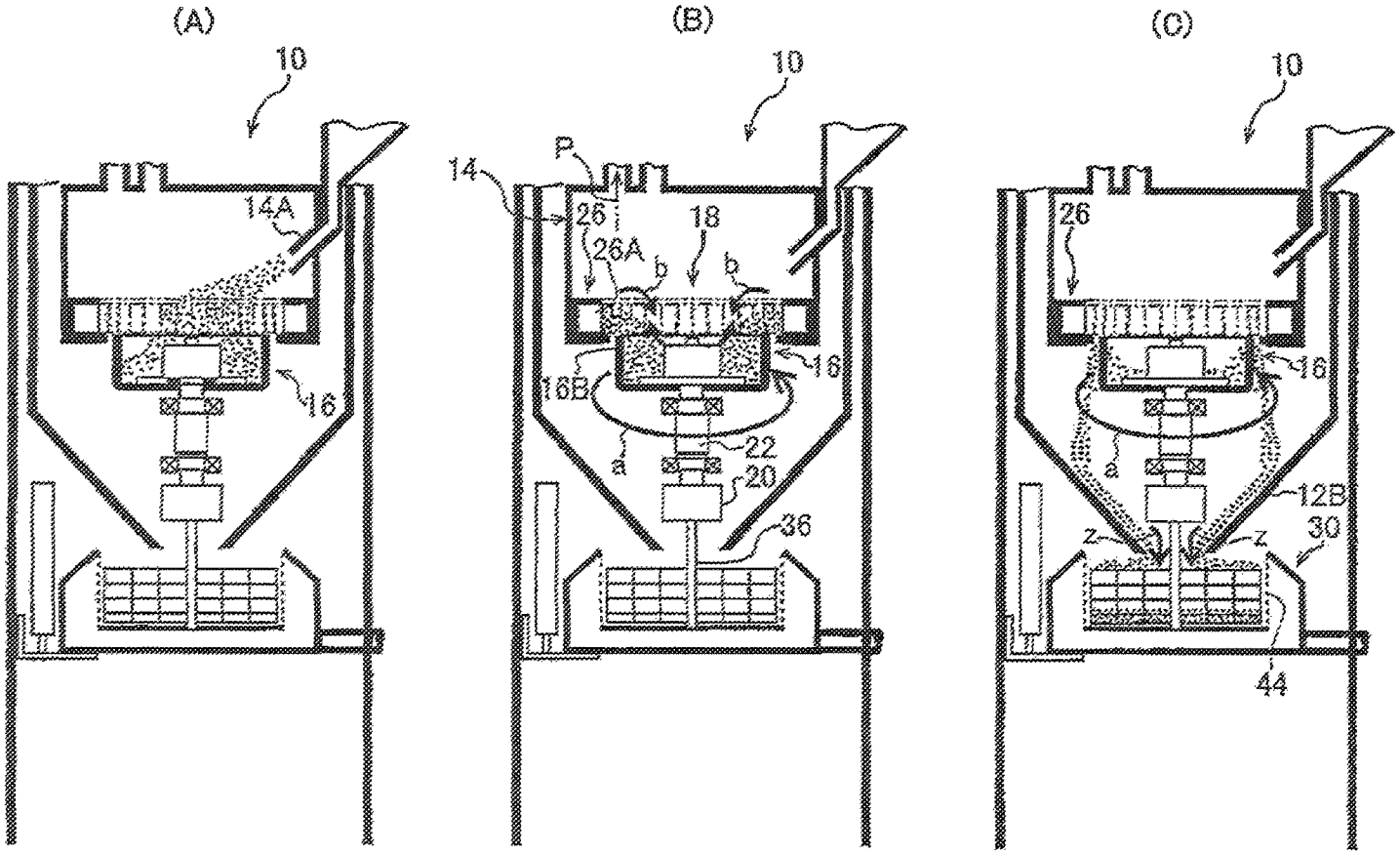
FIG. 2 illustrates schematic vertical and sectional views that show parts of the steps of the method for reclaiming foundry sand as the first embodiment of the present invention.

FIG. 2 shows schematic vertical and sectional views of the step of mechanically reclaiming the foundry sand 54 (see FIG. 5). As shown in FIG. 2(A), the sand that has been used is supplied (thrown into) to the rotor 16 through the chute for feeding sand 14A (the first step). In the drawings, the sand is schematically illustrated by dots (as also in FIGS. 3, 4, and 6-9).

Next, as shown in FIG. 2(B), the mechanism for generating the frictional force 18 generates it on the sand in the rotor 16 (the second step). In this step, when the driver 20 rotates the rotor 16 of the mechanism for generating the frictional force 18 (see the arrow "a"), the particles of the sand that have been supplied to the rotor 16 are gradually deposited inside the side wall 16B of the rotor 16 by centrifugal force while scraping each other. The particles of the sand that go beyond the upper end of the rotor 16 are hit by the blades 26A to be returned inside the rotor 16 (see the arrow "b"). Thus they again scrape each other. Aggregates are separated into single particles. In this way, incrustations (liquid-crystal) on the surfaces of the particles of the sand are cracked since the sand is hit by the blades 26A and the particles scrape each other. Thus the solubility of the incrustations in water becomes high. Some incrustations are removed from the surfaces. Further, since the roughness of the surfaces of the incrustations becomes coarse, the surface areas of the incrustations increase.

During this step, the clutch between the rotating shaft 22 and the driver 20, which is not shown, transmits the power from the driver 20, and the clutch between the shaft for agitation 36 and the driver 20, which is not shown, does not transmit the power from the driver 20. The pressure in the container for treatment 14 is negative because of the suction from the dust collector 50 (see FIG. 1) (the direction to suction the container for treatment 14 is shown by the arrow "P"). Thus the airflow toward the container for treatment 14 arises between the ring 26 and the rotor 16 so that generally no sand leaks through the gap between the rotor 16 and the ring 26.

Next, as shown in FIG. 2(C), the sand in the rotor 16 drops into the container for washing with water 30 that is located below the rotor 16 (the third step). In this step, since the suctioning from the dust collector 50 (see FIG. 1) stops, the negative pressure in the container for treatment 14 is discontinued, so that the sand can leak through the gap between the rotor 16 and the ring 26 (the mechanism for releasing the sand). The sand that has been leaked flows along the hopper 12B to drop into the container for washing with water 30 (inside the mesh made of stainless steel 44) (see the arrow "z"). Thus the container for washing with water 30 receives the sand that has been discharged from the rotor 16.

For mechanically reclaiming the sand by the apparatus for reclaiming the foundry sand 10 of the present embodiment, a configuration for a treatment (a so-called batch-type treatment) in which a predetermined amount of the sand is supplied to the rotor 16 and processed by it, and then the processed sand is discharged from it, is adopted.

Figure 3:
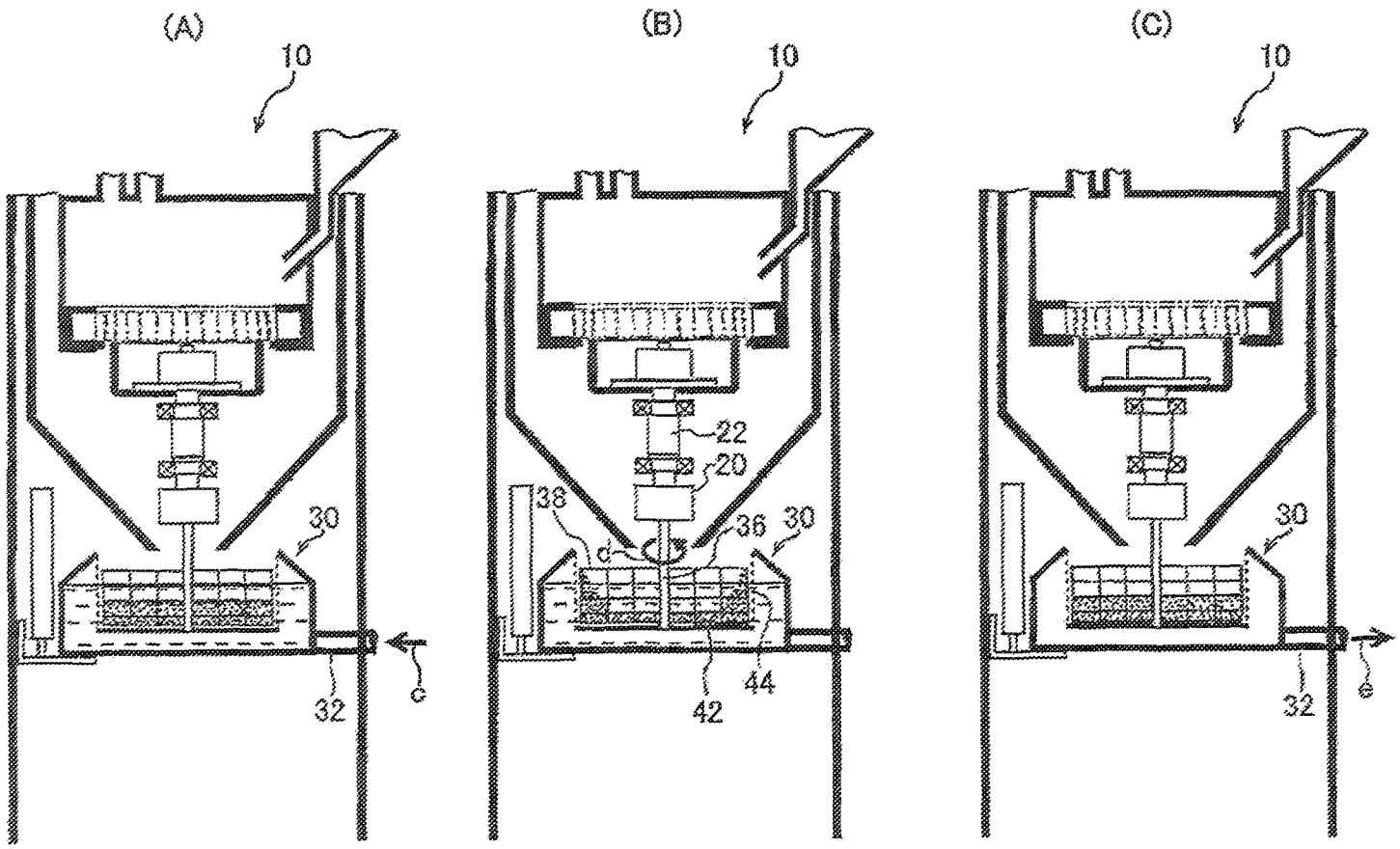
FIG. 3 illustrates schematic and vertical sectional views that show parts of the steps of the method for reclaiming foundry sand as the first embodiment of the present invention.

FIG. 3 shows schematic vertical and sectional views of the step of reclaiming the foundry sand by washing with water (hot water) 55 (see FIG. 5). As shown in FIG. 3(A), the water for washing is supplied to the container for washing with water 30 that contains the sand through the tube for supplying and draining water 32 (see the arrow "c"). A metering pump or a water heater is used to supply the water. The water may be at the ambient temperature or hot. Abrasives such as balls made of alumina are fed into the container for washing with water 30.

Next, as shown in FIG. 3(B), the sand in the container for washing with water 30 is washed with the water (the fourth step). During this step, the clutch between the rotating shaft 22 and the driver 20, which is not shown, does not transmit the power from the driver 20, but the clutch between the shaft for agitation 36 and the driver 20, which is not shown, does transmit the power from the driver 20. When the driver 20 rotates the shaft for agitation 36 (see the arrow "d"), the sand, the water, and the abrasives in the container for washing with water 30 are agitated by the blades for agitation 38 so that the incrustations on the surfaces of the particles of the sand are scraped off by the abrasives. The incrustations, etc., that have been cracked are separated from the sand to be dissolved by water in the container for washing with water 30. This utilizes the characteristics of liquid-crystal in the incrustations to be dissolved in water. Since the surfaces of the incrustations have been roughened and the surface areas increase during the step of mechanically reclaiming the foundry sand 54 (see FIGS. 2 and 5) in this embodiment, the areas of the incrustations in contact with water during washing increase, so that the rate of being dissolved in water of the incrustations becomes high.

In this embodiment, the internally-located board 42 that is connected to the lower end of the shaft for agitation 36 via the bearing 40 (see FIG. 1) is placed horizontally in the container for washing with water 30. Thus the periphery of the internally-located board 42 connects the entire upper opening of the container for washing with water 30 by the mesh made of stainless steel 44. Thus the sand that has dropped into the container for washing with water 30 is received by the inner face of the mesh made of stainless steel 44 on the internally-located board 42. Thus, when the agitator 34 rotates, the incrustations on the surfaces of the particles of the sand are scraped off by the mesh made of stainless steel 44.

Figure 4:
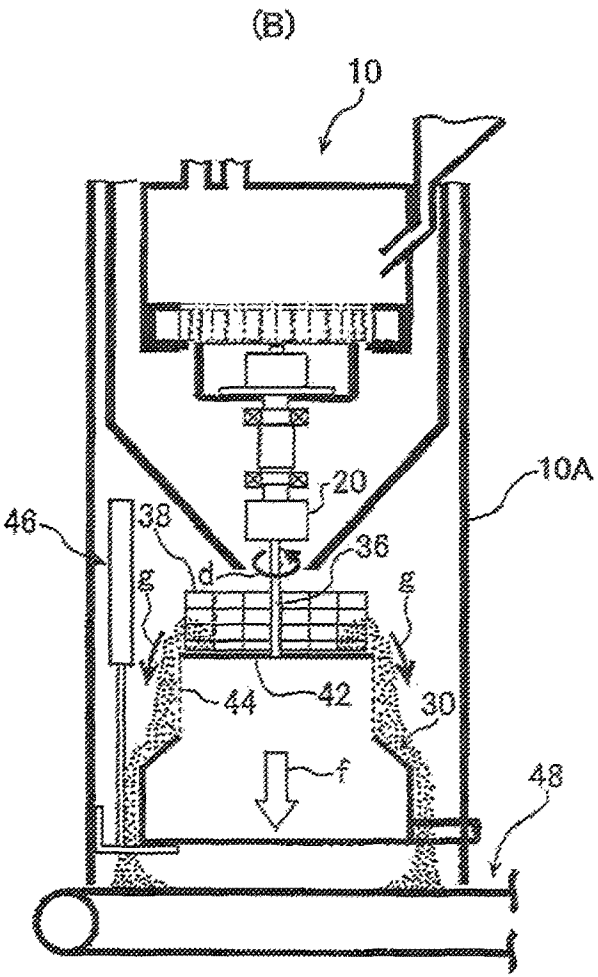
FIG. 4 illustrates schematic and vertical sectional views that show parts of the steps of the method for reclaiming foundry sand as the first embodiment of the present invention.
Figure 4:
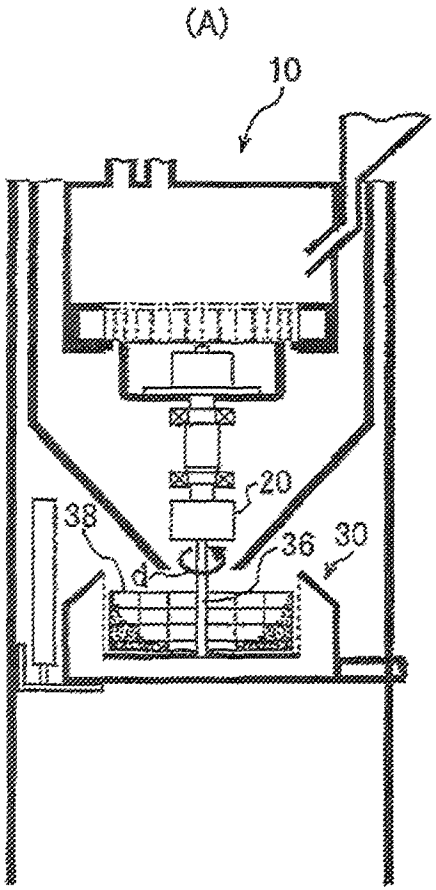

Next, as shown in FIG. 3(C), the water in the container for washing with water 30 is drained through the tube for supplying and draining water 32 (see the arrow "e"). FIG. 4 shows schematic vertical and sectional views of the step of the after-treatment.

As shown in FIG. 4(A), centrifugal dewatering is carried out after draining the water. During this step, the clutch between the shaft for agitation 36 and the internally-located board 42, which is not shown, is switched from the condition for not transmitting the power of the driver 20 to the condition for transmitting it so that the shaft for agitation 36, the blades for agitation 38, and the container for washing with water 30 are rotated at a high speed. Thus centrifugal force is generated in the sand so that it is pressed against the mesh made of stainless steel 44 and the moisture of the sand is removed.

Next, as shown in FIG. 4(B), the sand is discharged from the container for washing with water 30. During this step, the clutch between the shaft for agitation 36 and the driver 20, which is not shown, is switched from the condition for not transmitting the power of the driver 20 to the condition for transmitting it. While the blades for agitation 38 are rotated, the vertically-moving machine 46 lowers the container for washing with water 30 (see the arrow "f"). When doing so, one end of the mesh made of stainless steel 44 goes down together with the container for washing with water 30 so that the sand on the internally-located board 42 flows outwardly by centrifugal force and drops (see the arrow "g"). Since the mesh made of stainless steel 44 connects the periphery of the internally-located board 42 to the upper opening of the container for washing with water 30, the sand that drops is discharged along the outside of the mesh made of stainless steel 44 and the container for washing with water 30 to the conveyor belt 48 that is located below the main body 10A. The conveyor belt 48 transports the sand that has been reclaimed in the main body 10A to a predetermined direction.

As shown in FIG. 1, since the rotating shaft 22 (the axis of rotation of the rotor 16) is coaxial with the shaft for agitation 36 in this embodiment, the power of the driver 20 is transmitted to the rotor 16 and the agitator 34 while the space is reduced.

As discussed above, by the apparatus for reclaiming the foundry sand 10 or the method for reclaiming foundry sand of the present embodiment, binders and so on that attach to returned foundry sand that has been used can be effectively removed. Thus the foundry sand is repeatedly used for a mold.

Now we discuss supplementary matters. Assume that used core sand is used to produce foamed mulled sand. If a lot of water-shedding foreign substances or binders adhere to the particles of the core sand, more of a blowing agent, water, or inorganic liquid-crystal binders are required compared to green sand. Thus the time required to take a product out of a mold after casting becomes long. Further, an odor may be generated. These are disadvantages. Thus by a method in which a lot of incrustations remain on the surfaces of the particles of core sand, it is difficult to repeatedly reuse core sand.

In contrast, by the present embodiment, incrustations are effectively removed from core sand (providing a constant and stable ability to reclaim foundry sand). Thus the hydrophilicity of reclaimed core sand becomes high, so that by adding more of a blowing agent, or water, or inorganic liquid-crystal binders, to it, the amount of which is the correct amount for green sand, a product can be obtained during a time similar to that necessary to obtain a product from green sand. Thus core sand can be repeatedly used.

A Variation of the First Embodiment

As a variation of the first embodiment, the lower end of the hopper 12B and the upper end of the container for washing with water 30 of the apparatus for reclaiming the foundry sand 10 as in FIG. 1 may be separated, and an air classifier (an air separator for removing fine particles) may be provided there. For example, a pipe for discharging air (not shown) that is connected to the dust collector 50 (the suctioning port) may be connected to the side wall of the main body 10A at the height between the lower end of the hopper 12B and the upper end of the container for washing with water 30. Also, a port for suctioning air may be formed in the opposite side of the side wall of the main body 10A. Sand that has been discharged from the lower end of the hopper 12B is subject to the airflow by such an air classifier. Thus light materials that are removed from the sand to flow in the airflow are separated from heavy materials such as the sand. The heavy materials are dropped into the container for washing with water 30.

By the method for reclaiming foundry sand that uses that variation, sand that is dropped from rotor 16 is subject to the airflow in the third step so that light materials that are removed from the sand to flow in the airflow are separated from heavy materials that drop, and so that the heavy materials are dropped into the container for washing with water 30. Thus incrustations that are separated from the sand are prevented or suppressed from entering the container for washing with water 30.

In addition to the configuration of the variation or instead of the air classifier of the variation, a vibrating sieve that removes fine glass particles or fine liquid-crystal particles may be provided above the container for washing with water 30.

Second Embodiment

Figure 6:
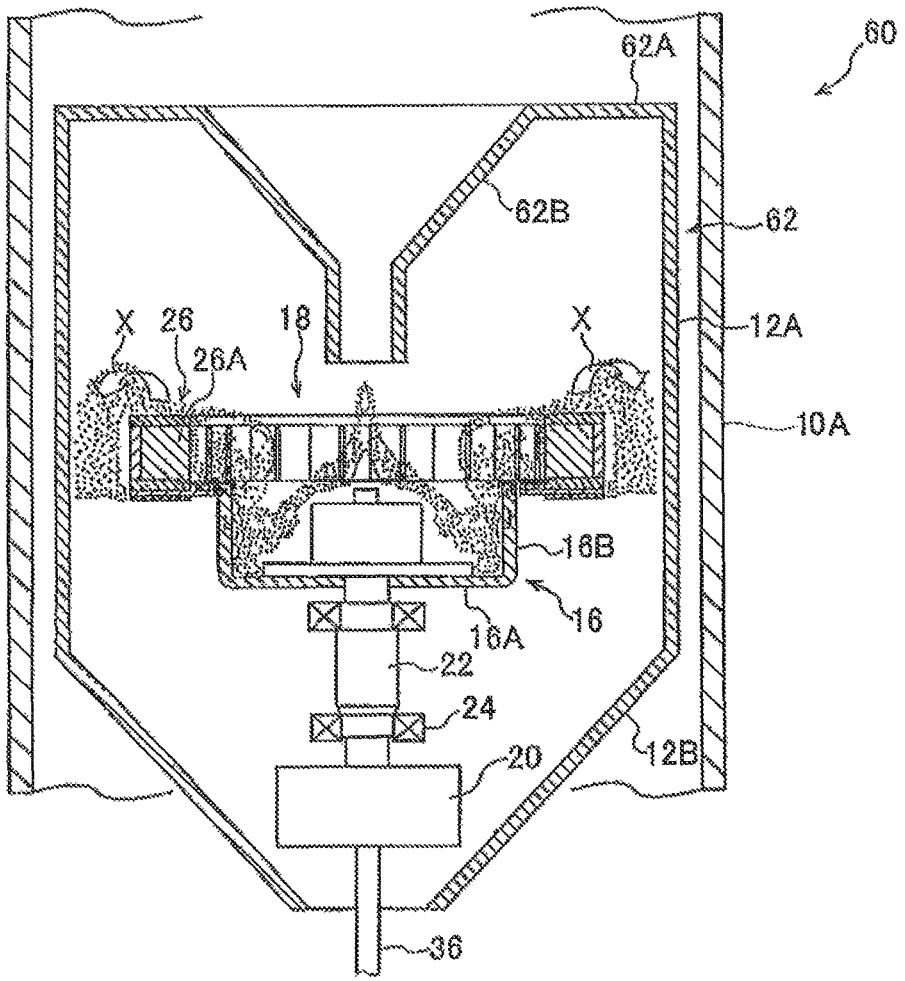
FIG. 6 is a vertical and sectional view of a part of the apparatus for reclaiming foundry sand as the second embodiment of the present invention.

Next, with reference to FIG. 6, an apparatus for reclaiming foundry sand 60 and a method for reclaiming foundry sand of the second embodiment of the present invention is discussed. FIG. 6 shows a vertical and sectional view of the upper portion of the apparatus for reclaiming foundry sand 60. As shown in FIG. 6, the apparatus for reclaiming foundry sand 60 differs from the apparatus for reclaiming the foundry sand 10 (see FIG. 1) in that it has no element that corresponds to the container for treatment 14 (see FIG. 1) of the first embodiment and in that it has an upper container 62 instead of the upper container 12 (see FIG. 1). The other elements are substantially the same as those of the first embodiment. Thus the elements that are substantially the same as those of the first embodiment are referred to by the same symbols, and their discussions are omitted.

As shown in FIG. 6, the upper container 62 is provided in the upper portion of the main body 10A. Since the upper container 62 has the same elements as the upper container 12 (see FIG. 1) of the first embodiment, except for the upper portion, the same elements are referred to by the same symbols. A funnel-shaped chute for feeding the sand 62B is formed downwardly from the center of the ceiling 62A of the upper container 62. The chute for feeding the sand 62B is used for feeding foundry sand that has been used. Its lower opening is positioned above the rotor 16. The chute for feeding the sand 62B is equipped with a gate for adjusting the flow of the sand (not shown).

With this configuration, sand that has been used is continuously fed to the rotor 16. The sand that goes from the inside of the rotor 16 and over the ring 26 (see the arrow "X") drops into the container for washing with water 30 (see FIG. 1) that is located below the rotor 16 (the third step).

By the apparatus for reclaiming foundry sand 60 and the method for reclaiming sand of the present embodiment, which are discussed above, binders and so on that attach to returned sand that has been used are also effectively removed.

Third Embodiment

Figure 7:
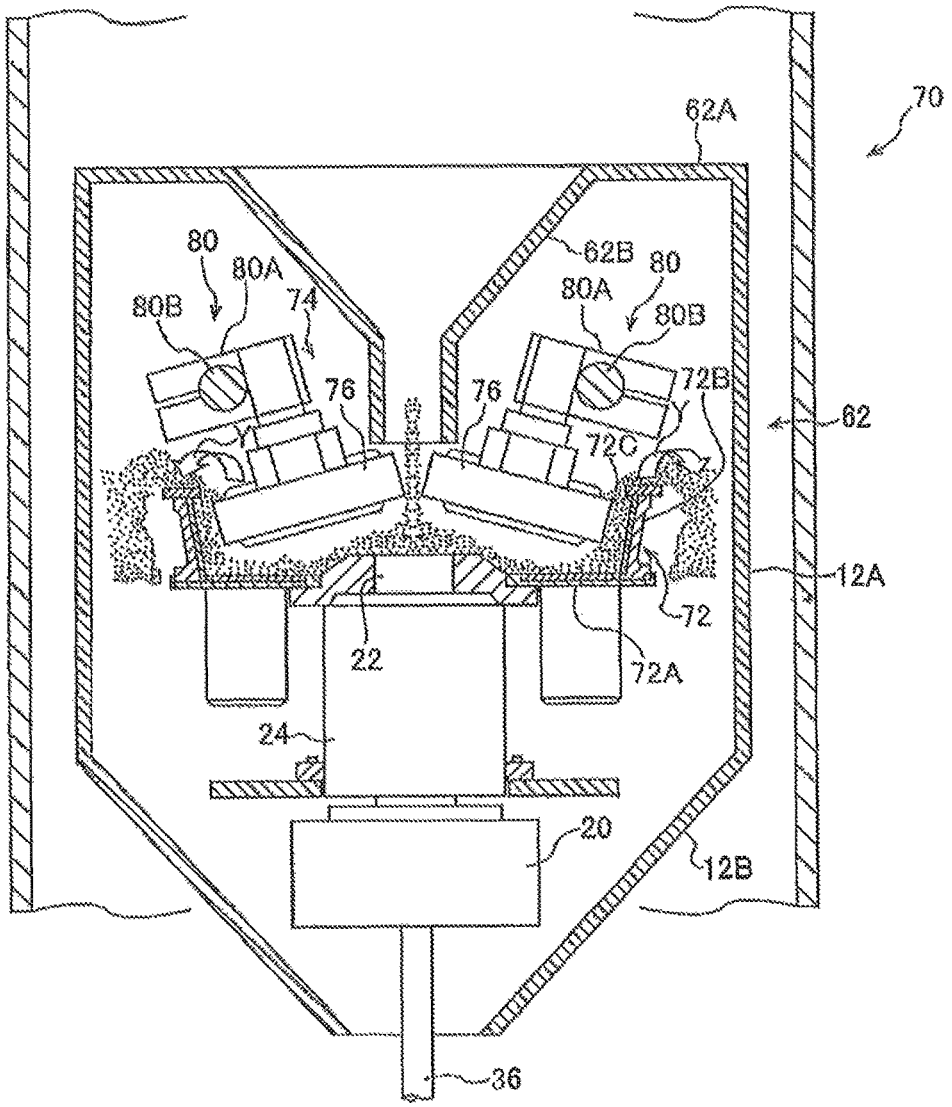
FIG. 7 is a vertical and sectional view of a part of the apparatus for reclaiming foundry sand as the third embodiment of the present invention.

Next, with reference to FIG. 7, an apparatus for reclaiming foundry sand 70 and a method for reclaiming foundry sand of the third embodiment of the present invention is discussed. FIG. 7 shows a vertical and sectional view of the upper portion of the apparatus for reclaiming foundry sand 70. As shown in FIG. 7, the apparatus for reclaiming foundry sand 70 differs from the apparatus for reclaiming foundry sand 60 (see FIG. 6) of the second embodiment in that it has a drum 72 as a container for treatment (the section for treatment) instead of the rotor 16 (see FIG. 6) of the second embodiment and in that it has a mechanism for generating frictional force 74 instead of the mechanism for generating the frictional force 18 (see FIG. 6). The other elements are substantially the same as those of the first or second embodiment. Thus the elements that are substantially the same as those of the first or second embodiment are referred to by the same symbols, and their discussions are omitted.

As shown in FIG. 7, the drum 72 has a circular bottom 72A that is horizontally placed, an inclined side wall 72B that inclines from the periphery of the bottom 72A so that its diameter increases upwardly, and a weir 72C that extends inward from the upper end of the inclined side wall 72B.

The mechanism for generating the frictional force 74 is configured to include a pair of rollers 76 that are rotatably disposed inside the drum 72 and a mechanism for pressing the rollers 80 that is provided to the bearing for each of the rollers 76. The rollers 76 are located to face one another and to keep a gap between them and the inclined side wall 72B.

The mechanism for pressing the rollers 80 is configured to include a supporting arm 80A that includes a bearing for each of the rollers 76 and a horizontal shaft 80B that is attached to the supporting arm 80A and extends in the direction perpendicular to the plane of FIG. 7. The horizontal shaft 80B is moved by a cylinder that is a part of the mechanism for pressing the rollers 80 (not shown), so that the rollers 76 come close to, and retract from, the inclined side wall 72B. Thus the mechanism for pressing the rollers 80 presses the rollers 76 toward the inclined side wall 72B. Rotating the drum 72 by means of the driver 20 generates the frictional force on the particles of the sand in the drum 72.

By the apparatus for reclaiming foundry sand 70, when the driver 20 of the mechanism for generating the frictional force 74 rotates the drum 72, the particles of the sand that have been fed to the drum 72 scrape each other and are deposited by centrifugal force on the inner face of the inclined side wall 72B of the drum 72. When the particles of the sand that have been deposited on the inner face of the inclined side wall 72B come close to the rollers 76, frictional force is generated on those particles by the rotation of the rollers 76. Thus incrustations of the surfaces of the particles of the sand are cracked and some of them are removed from the sand. In this way, the mechanism for generating the frictional force 74 generates the frictional force on the particles of the sand in the drum 72 (the second step).

When the layer of the sand that has been deposited inside the inclined side wall 72B becomes thick, the sand that goes from the inside of the drum 72 over the weir 72C (see the arrow "Y") drops into the container for washing with water 30 (see FIG. 1) that is positioned below the drum 72 (the third step).

By the apparatus for reclaiming foundry sand 70 and the method for reclaiming foundry sand of the present embodiment, which are discussed above, binders and so on that attach to returned foundry sand that has been used are also effectively removed.

Other Embodiments of the Method for Reclaiming Foundry Sand

Figure 8:
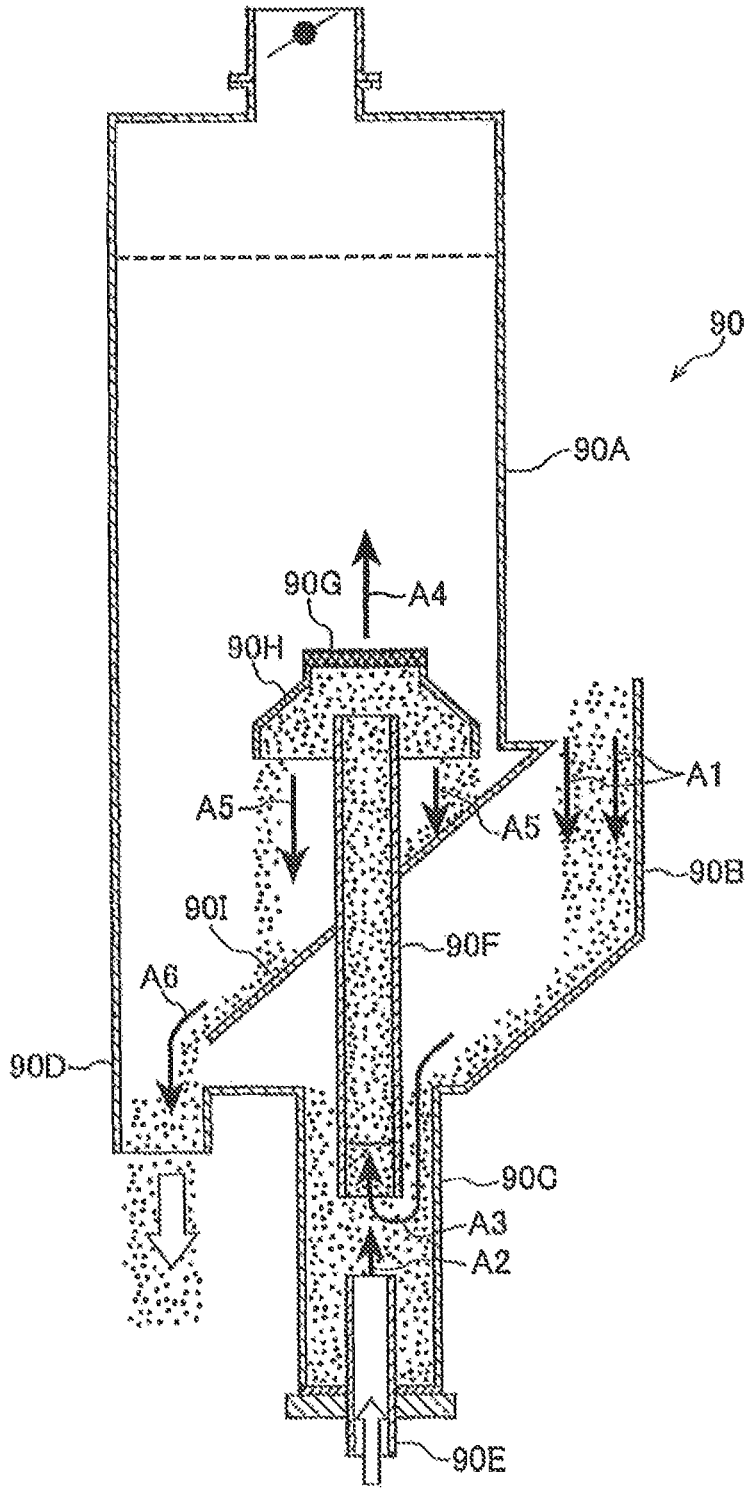
FIG. 8 is a vertical and sectional view of a machine for reclaiming foundry sand by generating an impact. It is used for another embodiment of the method for reclaiming foundry sand of the present invention.
Figure 9:
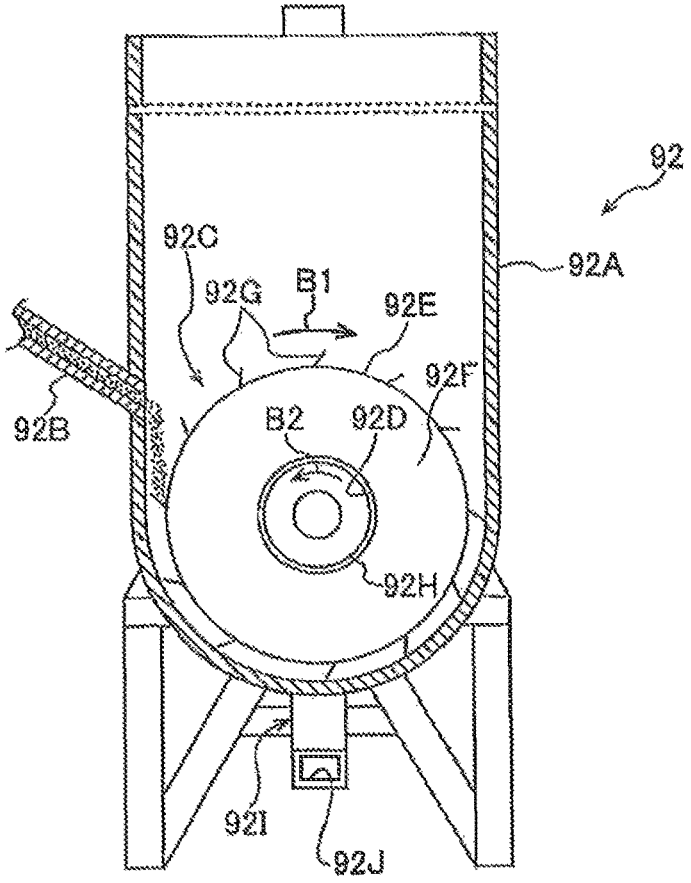
FIG. 9 is a vertical and sectional view of a machine for reclaiming foundry sand by a grinding wheel that is used for another embodiment of the method for reclaiming foundry sand of the present invention.

For other embodiments of the method for reclaiming foundry sand, the first step, the second step, and the third step may be carried out by a device for reclaiming foundry sand by means of an impact 90 as in FIG. 8 or a device for reclaiming foundry sand by means of a grinding wheel 92 as in FIG. 9.

First, the device for reclaiming foundry sand by means of an impact 90 as in FIG. 8 is discussed. The device for reclaiming foundry sand by means of an impact 90 has a treating container 90A as the section for treatment. The treating container 90A is configured to have three tubes, where the lower portion has two tubes. It is disposed so that its longitudinal axis runs vertically. A chute for feeding the sand 90B is connected to a side of the treating container 90A. The chute for feeding the sand 90B forms a flow channel for the sand that has been used to be fed to the treating container 90A. The lower portion of the treating container 90A, which bifurcates, has a first piping 90C and a second piping 90D. The lower opening of the first piping 90C is plugged and a nozzle for pressurized air 90E is inserted in it.

Within the treating container 90A an inner pipe 90F is placed above the top end of the nozzle 90E so that its longitudinal axis runs vertically. The lower end of the inner pipe 90F is disposed a short distance from the tip of the nozzle 90E. A board against which the sand collides (colliding board) 90G is provided to face the upper opening of the inner pipe 90F. The colliding board 90G is disposed a short distance from the upper opening of the inner pipe 90F. It is made of a mesh. The size of the mesh of the colliding board 90G permits air to pass through it, but no sand can do so. Inside the treating container 90A, guides 90H, 901 are formed so that the sand that collides with, and bounces back from, the colliding board 90G is guided to the second piping 90D. A container for washing with water, which is not shown, is provided under the second piping 90D.

In the device for reclaiming foundry sand by means of an impact 90 as discussed above, the sand that has been used is at first fed from the chute for feeding the sand 90B to the treating container 90A (see the arrow "A1") (the first step). The fed sand, with compressed air that blows out from the nozzle 90E (see the arrow "A2"), enters the inner pipe 90F (see the arrow "A3"). It passes through the inner pipe 90F and collides with the colliding board 90G. Thus the force of impact is generated on the sand in the treating container 90A (the second step). At this time compressed air passes through the colliding board 90G (see the arrow "A4") and the sand bounces back from the colliding board 90G. The sand that has bounced back is guided by the guides 90H, 901 (see the arrows "A5" and "A6") to be discharged through the downward opening of the second piping 90D. It drops into the container for washing with water (not shown) that is below the treating container 90A (the third step).

Next, the device for reclaiming foundry sand by means of a grinding wheel 92 as in FIG. 9 is discussed. The device for reclaiming foundry sand by means of a grinding wheel 92 has a treating container 92A as the section for treatment. The treating container 92A has an upper portion that is formed like a rectangular tube that extends vertically. It also has a lower portion that is formed like a semicircular tube with the center of its arc facing in the horizontal direction (the direction perpendicular to the plane of FIG. 9). A chute for feeding the sand 92B is connected to a side of the treating container 92A. The chute for feeding the sand 92B forms a flow channel for the sand that has been used to be fed to the treating container 92A.

Within the treating container 92A a rotating drum 92C is disposed. In the rotating drum 92C an inner tube 92D and an outer tube 92E that run coaxially to one another are connected by a side plate 92F. They rotate clockwise in FIG. 9 (see the arrow "B1"). On the outer surface of the outer tube 92E of the rotating drum 92C a plurality of scratching tips 92G are provided. The scratching tips 92G are located along the circumference of the rotating drum 92C. A plurality of through-holes (not shown) are formed in the outer tube 92E and the inner tube 92D of the rotating drum 92C so that the outer radial side of the outer tube 92E and the inner radial side of the inner tube 92D are fluidly connected.

A cylindrical grinding wheel 92H is disposed to be coaxial to the rotating drum 92C in the inner side of the inner tube 92D of the rotating drum 92C. A gap is formed between the inner side of the inner tube 92D and the outer side of the grinding wheel 92H so as to receive the sand. The grinding wheel 92H rotates in the direction (see the arrow "B2") that is opposite to that of the rotating drum 92C. A discharging pipe 92I for discharging sand and so on from the treating container 92A is connected to the lower portion of the treating container 92A. The discharging pipe 92I is formed like a tube. Below the lower opening 92J of the discharging pipe 92I a container for washing with water, which is not shown, is provided.

In the device for reclaiming foundry sand by means of a grinding wheel 92 foundry sand that has been used is at first fed from the chute for feeding the sand 92B to the treating container 92A (the first step). The fed sand is scratched and raised by the scratching tip 92G to be conveyed from the outer side of the outer tube 92E of the rotating drum 92C to the inner side of the inner tube 92D. There it bumps the grinding wheel 92H, to then be ground. That is, the force of impact and the frictional force by the grinding wheel 92H are imparted to the sand in the treating container 92A (the second step). The sand that has been processed in the treating container 92A is discharged from the lower opening 92J of the discharging pipe 92I to drop into the container for washing with water (not shown) below the treating container 92A (the third step).

By the method for reclaiming foundry sand that uses the device for reclaiming foundry sand by means of an impact 90 as in FIG. 8 or the device for reclaiming foundry sand by means of a grinding wheel 92 as in FIG. 9, which are discussed above, binders and so on that attach to returned foundry sand that has been used are also effectively removed.

Supplement to Discussion of Embodiments

In the first three embodiments as in FIG. 1, etc., the rotating shaft 22 and the shaft for agitation 36 are coaxial to one another. This configuration is preferable for reducing the space of the apparatus. However, the axis of rotation of the container for treatment need not be coaxial to the shaft for agitation.

In the above embodiments the section made of netting that connects the entire periphery of the internally-located board 42 to the entire upper opening of the container for washing with water 30 is the mesh made of stainless steel 44.

However, the section made of netting may be a mesh made of other materials, such as a synthetic resin. In the above embodiments, the internally-located board 42 and the mesh made of stainless steel 44 are provided. However, they need not be provided.

In the above embodiments the vertically-moving machine 46 has the air cylinder 46B. However, it may be any other type of vertically-moving machine that has a hydraulic cylinder or an elevator instead of the air cylinder 46B. The vertically-moving machine need not be provided.

In the above embodiment, while the water for washing contains the abrasives at the fourth step, the sand, water, and the abrasives are agitated in the container for washing with water 30. This process is preferable. However, at the fourth step the sand and the water may be agitated without using any abrasives.

At the fourth step the sand in the container for washing with water may be mixed or agitated by a rotating drum or a sand muller. Further, after the fourth step the abrasives are preferably separated from the sand in the container for washing with water by using a sieve using flowing water or a vibrating sieve.

To dry the sand after it is dewatered a dryer may be provided that utilizes the heat that is generated when the driver of the mechanism for generating the frictional force rotates the container for treatment and the agitator.

The above variations may be provided in any combination.

Below, the main symbols used in the specification and drawings are listed.

10 apparatus for reclaiming foundry sand
16 a rotor (the container for treatment or the section for treatment)
16A a bottom
18 a mechanism for generating the frictional force
20 a driver
22 a rotating shaft (the axis of rotation of the container for treatment)
26 a ring
26A blades
30 a container for washing with water
34 an agitator
36 a shaft for agitation
38 blades for agitation
40 a bearing
42 an internally-located board
44 a mesh made of stainless steel (a section made of netting)
46 a vertically-moving machine
60 apparatus for reclaiming foundry sand
70 apparatus for reclaiming foundry sand
72 a drum (the container for treatment or the section for treatment)
72A a bottom
72B an inclined side wall
72C a weir
74 a mechanism for generating frictional force
76 a roller
80 a mechanism for pressing rollers
90A a treating container (a section for treatment)
92A a treating container (a section for treatment)

The invention claimed is:

1. An apparatus for reclaiming foundry sand comprising:
a container for treatment to which foundry sand that has been used is supplied;
a mechanism for generating frictional force that has a driver that rotates the container for treatment about a vertical axis, the mechanism generating frictional force on sand in the container for the treatment by rotating the container;
a container for washing with water that is located below the container for treatment and that can have water supplied to and drained from the container for washing with water, which container for washing with water can receive sand that has been discharged from the container for treatment; and
an agitator that has a shaft for agitation that is connected to the driver to be rotated about a vertical axis, and blades for agitation that are attached to the shaft for agitation and located within the container for washing with water; wherein the container for treatment is cylindrical rotor with a horizontal bottom, and
wherein the mechanism for generating the frictional force has a ring that is adjacent to, and outside of, the upper end of the rotor, the ring having a plurality of blades that are circularly arranged and, in a planar view, incline opposite the direction of the rotation of the rotor in the inner radial direction.

2. An apparatus for reclaiming foundry sand comprising:
a container for treatment to which foundry sand that has been used is supplied;
a mechanism for generating frictional force that has a driver that rotates the container for treatment about a vertical axis, the mechanism generating frictional force on sand in the container for the treatment by rotating the container;
a container for washing with water that is located below the container for treatment and that can have water supplied to and drained from the container for washing with water, which container for washing with water can receive sand that has been discharged from the container for treatment; and
an agitator that has a shaft for agitation that is connected to the driver to be rotated about a vertical axis, and blades for agitation that are attached to the shaft for agitation and located within the container for washing with water;
an internally-located and horizontal board that is placed in the container for washing with water and connected to a lower end of the shaft for agitation via a bearing; and
a section made of netting that connects the entire periphery of the internally-located board with the upper opening of the container for washing with water.

3. The apparatus for reclaiming foundry sand of claim 2, wherein the container for washing with water is equipped with a vertically-moving machine that moves the container for washing with water up and down.

4. An apparatus for reclaiming foundry sand comprising:
a container for treatment to which foundry sand that has been used is supplied;
a mechanism for generating frictional force that has a driver that rotates the container for treatment about a vertical axis, the mechanism generating frictional force on sand in the container for the treatment by rotating container;
a container for washing with water that is located below the container for treatment and that can have water supplied to and drained from the container for washing with water, which container for washing with water can receive sand that has been discharged from the container for treatment; and
an agitator that has a shaft for agitation that is connected to the driver to be rotated about a vertical axis, and blades for agitation that are attached to the shaft for agitation and located within the container for washing with water;

wherein an axis of rotation of the container for treatment is coaxial with the shaft for agitation, wherein the container for treatment is cylindrical rotor with a horizontal bottom, and wherein the mechanism for generating the frictional force has a ring that is adjacent to, and outside of, the upper end of the rotor, the ring having a plurality of blades that are circularly arranged and, in a planar view, incline opposite the direction of the rotation of the rotor in the inner radial direction.

5. An apparatus for reclaiming foundry sand comprising:

a container for treatment to which founder sand that has been used is supplied;

a mechanism for generating frictional force that has a driver that rotates the container for treatment about a vertical axis, the mechanism generating frictional force on sand in the container for the treatment by rotating the containers;

a container for washing with water that is located below the container for treatment and that can have water supplied to and drained from the container for washing with water, which container for washing with water can receive sand that has been discharged from the container for treatment; and an agitator that has a shaft for agitation that is connected to the driver to be rotated about a vertical axis, and blades for agitation that are attached to the shaft for agitation and located within the container for washing with water;

wherein an axis of rotation of the container for treatment is coaxial with the shaft for agitation, the apparatus for reclaiming foundry sand further comprising:

an internally-located and horizontal board that is placed in the container for washing with water and connected to a lower end of the shaft for agitation via a bearing; and a section made of netting that connects the entire periphery of the internally-located board with the upper opening of the container for washing with water.

6. An apparatus for reclaiming foundry sand comprising:

a container for treatment to which foundry sand that has been used is supplied;

a mechanism for generating frictional force that has a driver that rotates the container for treatment about a vertical axis, the mechanism generating frictional force on sand in the container for the treatment by rotating the container;

a container for washing with water that is located below the container for treatment and that can have water supplied to and drained from the container for washing with water, which container for washing with water can receive sand that has been discharged from the container for treatment; and an agitator that has a shaft for agitation that is connected to the driver to be rotated about a vertical axis, and blades for agitation that are attached to the shaft for agitation and located within the container for washing with water;

wherein the container for treatment is a drum that has a circular and horizontal bottom, an inclined side wall that inclines so as to have its diameter increase upwardly from the periphery of the bottom, and a weir that extends inwardly from the upper end of the inclined side wall, and wherein the mechanism for generating the frictional force has rollers that rotate in the drum, which rollers are disposed to face each other such that gaps between parts of the outer faces of the rollers and the inclined side wall are formed, and a mechanism for pressing the rollers that is disposed at bearings of the rollers to press the rollers toward the inclined side wall, the apparatus for reclaiming foundry sand further comprising:

an internally-located and horizontal board that is placed in the container for washing with water and connected to a lower end of the shaft for agitation via a bearing; and a section made of netting that connects the entire periphery of the internally-located board with the upper opening of the container for washing with water.

7. The apparatus for reclaiming foundry sand of claim 6, wherein the container for washing with water is equipped with a vertically-moving machine that moves the container for washing with water up and down.

* * * * *